US008135541B2

(12) United States Patent
Davis et al.

(10) Patent No.: US 8,135,541 B2
(45) Date of Patent: Mar. 13, 2012

(54) WELLBORE TRACKING

(75) Inventors: Eric Davis, El Cerrito, CA (US); Etienne Samson, Houston, TX (US); Craig Jackson, Oakland, CA (US); Ralf Krug, San Francisco, CA (US)

(73) Assignee: Halliburton Energy Services, Inc., Houston, TX (US)

( * ) Notice: Subject to any disclaimer, the term of this patent is extended or adjusted under 35 U.S.C. 154(b) by 771 days.

(21) Appl. No.: 12/109,155

(22) Filed: Apr. 24, 2008

(65) Prior Publication Data

US 2009/0271115 A1 Oct. 29, 2009

(51) Int. Cl.

| | |
|---|---|
| ***G01V 1/40*** | (2006.01) |
| ***G01V 1/00*** | (2006.01) |
| ***G06G 7/56*** | (2006.01) |
| ***E21B 47/00*** | (2006.01) |

(52) U.S. Cl. ..... 702/6; 703/5; 367/35; 166/255.2

(58) Field of Classification Search ..... 702/6, 1–2, 702/10–14, 16–17, 33, 85, 92, 94–95, 97, 702/127, 141, 150–159, 166–170, 182–183, 702/189; 703/5, 10; 367/25, 33, 35, 69, 367/73; 166/250.01, 254.1–254.2, 255.1–255.2; 73/1.75–1.77, 1.79, 1.81, 152.44, 152.46

See application file for complete search history.

(56) References Cited

U.S. PATENT DOCUMENTS 6,944,545 B2 * 9/2005 Close et al. ..... 702/6
7,028,772 B2 * 4/2006 Wright et al. ..... 166/250.01

OTHER PUBLICATIONS

Markley et al., Case Studies of Casing Deformation due to Active Stresses in the Andes, 2002, IADC/SPE 74561, pp. 1-7.*
Bruno, M., Geomechanical Analysis and Decision Analysis for Mitigating Compaction Related Casing Damage, 2001, SPE 71695, 13 pp.*
Wagg et al., Evaluating Casing Deformation, Dec. 2000, World Oil, pp. 1-3.*
Ispas et al., Prediction and Evaluation of Sanding and Casing Deformation in a GOM-Shelf Well, Feb. 2005, Technology Today Series, pp. 75-78.*

* cited by examiner

*Primary Examiner* — Michael Nghiem
*Assistant Examiner* — Toan M Le
(74) *Attorney, Agent, or Firm* — Schwegman, Lundberg & Woessner, P.A.

(57) ABSTRACT

Wellbore tracking by developing a wellbore deviation survey, including collecting wellbore deformation data using a caliper at each of a plurality of depths within the wellbore, collecting wellbore deviation data using a tiltmeter at ones of the plurality of depths, determining simulated wellbore deformation and deviation data using the oriented wellbore deformation data, and developing a wellbore deviation survey by calibrating the wellbore deviation data based on the oriented wellbore deviation data.

23 Claims, 14 Drawing Sheets

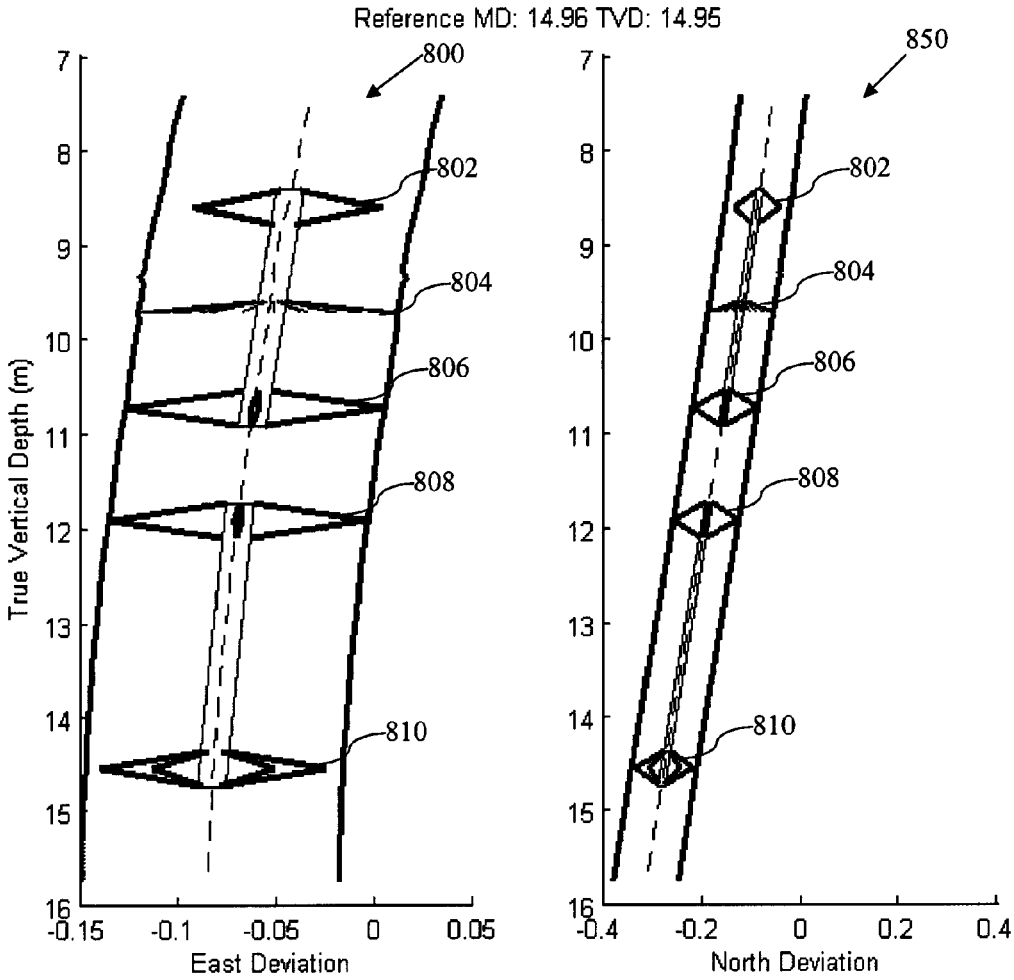
*Fig. 8A* *Fig. 8B*

WELLBORE TRACKING

BACKGROUND

Fluids are injected into the Earth for a variety of applications, such as for hydraulic fracture stimulation, waste injection, produced water re-injection, or for enhanced oil recovery processes like water flooding, steam flooding, or $CO_2$ flooding. In other applications, fluids are removed (or "produced") from the Earth, such as for oil and gas production, geothermal steam production, or for waste clean-up.

A recently identified need entails precisely mapping the deviation and deformation of a wellbore. However, existing survey instruments can not meet the necessary specifications for accuracy or precision. For example, while tiltmeter-based wellbore deviation measurement is known (as described in U.S. Pat. No. 6,944,545 to Close, et al.), deformation measurements based on tiltmeter data alone may not be practical for certain situations. Taking high precision tiltmeter measurements requires a stationary tool, and the large number of readings needed could result in an unreasonable time requirement to map a single wellbore. Moreover, while conventional caliper tools can provide casing deformation, and through double integration can provide wellbore deviation, there are significant errors which arise during the integration process that render the result untrustworthy over any significant distance. In addition, gyroscopes can also produce wellbore deviation surveys with some accuracy, but they do not provide the necessary casing deformation.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIGS. 8A and 8B are charts according to one or more aspects of the present disclosure.

DETAILED DESCRIPTION

Figure 1A:
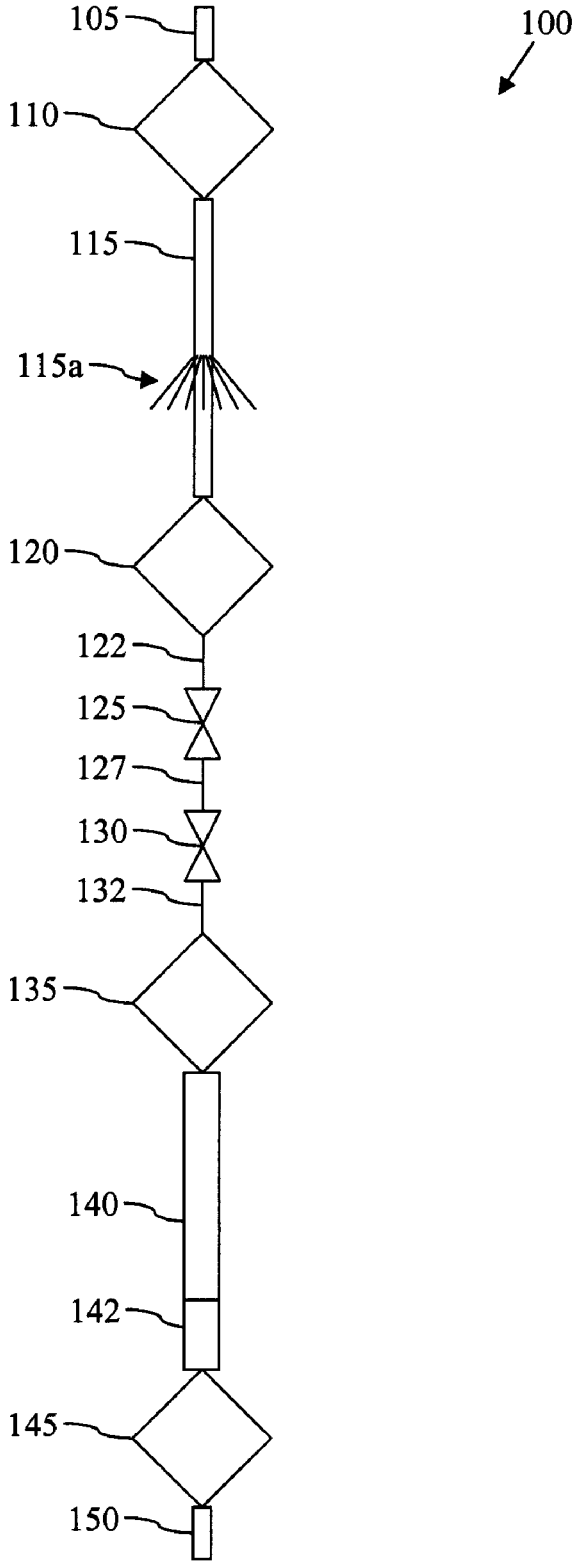
FIG. 1*a* is a schematic view of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure uses several terms to describe certain characteristics of a wellbore. "Deviation," sometimes also referred to as "inclination," describes the variance of the centerline of a well with respect to true vertical. "Deformation" describes the variance of the edges of a wellbore with respect to the centerline of a wellbore.

The present disclosure also uses several terms to describe a method of measuring certain characteristics of a wellbore. "Data" means a measurement of a characteristic of a wellbore. A "model" or "survey" is a representation of one or more pieces of data.

Referring to FIG. 1*a*, illustrated is a schematic view of at least a portion of an apparatus 100 according to one or more aspects of the present disclosure. In the exemplary embodiment depicted in FIG. 1*a*, components of the apparatus 100 include a wireline head 105, a centralizer 110, a caliper tool 115, another centralizer 120, a knuckle joint 125, another knuckle joint 130, another centralizer 135, a tiltmeter 140, an orientation tool 142, another centralizer 145, and a bull plug 150.

The wireline head 105 is configured to couple the apparatus 100 within a wireline, slick-line, e-line, or other working string within a wellbore. A wireline, slick-line, e-line, or other working string may be collectively referred to herein as a "wireline" although merely for the sake of convenience and readability of the present disclosure. The wireline head 105 is coupled to the centralizer 110. In an alternative embodiment, the centralizer 110 may be coupled directly to the wireline, thus eliminating the wireline head 105. However, in the exemplary embodiment shown in FIG. 1*a*, the wireline head 105 provides a mechanical and/or electrical fuse protecting the other components of the apparatus 100. The wireline head 105 may also provide a means for transferring communication and/or power between the apparatus 100 and the surface of the wellbore. In an exemplary embodiment, the wireline head 105 is or comprises an AES cable head, such as those commercially available from SONDEX. The wireline head 105 may also include or be coupled to a crossover component configured to provide a communications interface, a programmable logging controller, and/or a voltage converter (e.g., dc-to-dc), such as the XTU002 crossover ultrawire to ultralink commercially available from SONDEX.

The centralizer 110 may be coupled directly to the wireline head 105. Alternatively, an intermediate component may be coupled between the centralizer 110 and the wireline head 105. For example, a swivel or knuckle joint may be coupled between the centralizer 110 and the wireline head 105. In an exemplary embodiment, such interposing coupling may be or comprise a swivel joint such as the PSJ production swivel joint commercially available from SONDEX.

The centralizer 110 may be a conventional or future-developed centralizer. For example, the centralizer 110 may be or comprise a device having a hinged collar and bowsprings configured to keep at least adjacent portions of the apparatus 100 in a known position relative to the wellbore, most commonly the center of the wellbore, or in a known position relative to the tubing or casing within the wellbore. The centralizer 110 may also prevent the apparatus 100 from hanging up on obstructions on the wellbore wall. In the exemplary embodiment, the centralizer 110 is mounted in-line between the wireline head 105 and the caliper tool 115, although in other embodiments within the scope of the present disclosure the centralizer 110 may be mounted on the outside surface of the apparatus 100. In an exemplary embodiment, the centralizer 110 is or comprises the PRC034 4-arm production roller centralizer commercially available from SONDEX.

The caliper tool 115 may be or comprise a conventional or future-developed device configured for measuring the diameter of the internal wall of the casing, tubing, or wellbore using multiple arms or fingers 115*a*. By using a large number of arms or fingers, the caliper tool 115 can detect small changes in the wall of the casing, tubing, or wellbore, such as to detect deformations, the buildup of scale, or metal loss due to corrosion. The caliper tool 115 may comprise between about 20 and 80 fingers, although the number of fingers is not limited within the scope of the present disclosure. An example of the caliper tool 115 is the MIT24 multifinger imaging tool commercially available from SONDEX.

The caliper tool 115 is coupled between the centralizer 110 and the centralizer 120. The centralizer 120 may be identical or substantially similar to the centralizer 110. The centralizer 120 is coupled between the caliper tool 115 and the knuckle joint 125. The knuckle joint 125 may be coupled directly to the centralizer 120 or, as in the exemplary embodiment depicted in FIG. 1*a*, an intermediate member 122 may interpose the knuckle joint 125 and the centralizer 120. The intermediate member 122 may be or comprise a section of tubing, wire, or other relatively rigid structure configured to mechanically and/or electrically couple the knuckle joint 125 with the centralizer 120.

The knuckle joint 125 may be or comprise a conventional or future-developed joint allowing deflection in any direction, but not allowing rotation about a vertical axis between the components above and below the joint if both of those components depend on the same orientation tool 142 to determine apparatus 100 orientation. For example, the knuckle joint 125 may be or comprise the PKJ production knuckle joint commercially available from SONDEX.

The knuckle joint 125 is coupled between the centralizer 120 and the knuckle joint 130. The knuckle joint 130 may be identical or substantially similar to the knuckle joint 125. The knuckle joints 125, 130 may be directly coupled or, as in the exemplary embodiment depicted in FIG. 1*a*, an intermediate member 127 may interpose the knuckle joints 125, 130. The intermediate member 127 may be identical or substantially similar to the member 122.

The knuckle joint 130 is coupled between the knuckle joint 125 and the centralizer 135. The centralizer 135 may be identical or substantially similar to the centralizers 110, 120. The knuckle joint 130 may be coupled directly to the centralizer 135 or, as in the exemplary embodiment depicted in FIG. 1*a*, an intermediate member 132 may interpose the knuckle joint 130 and the centralizer 135. The intermediate member 132 may be identical or substantially similar to the members 122, 127.

The centralizer 135 is coupled between the tiltmeter 140 and the knuckle joint 130. The tiltmeter 140 is configured to collect downhole tilt data versus time. The design, operation, and/or function of the tiltmeter 140 may be as described in U.S. Pat. No. 7,028,772 to Wright, et al., the entirety of which is hereby incorporated by reference.

The tiltmeter 140 is coupled between the orientation tool 142 and the centralizer 135. According to one exemplary embodiment, the tiltmeter 140 may comprise an electrolytic sensor and means for determining the position of the sensor relative to the local gravitational vector. Other types of sensors, including many in the class of accelerometers, can function as a tiltmeter and be used to likewise determine the sensor position relative to the local gravitational vector. According to one exemplary embodiment, the orientation tool 142 may be coupled to the tiltmeter 140. However, in other exemplary embodiments, the orientation tool 142 may be coupled to any component of the apparatus 100. The orientation tool 142 may be a three (3) axis magnetic orientation device that allows determination of the tool orientation with respect to magnetic north. Other exemplary embodiments of the orientation tool 142 include conventional or north seeking mechanical gyroscopes, fiber optic gyroscopes, orientation markers embedded in the well (typically radioactive sources detected with a radiation sensor), and orientation detection devices that use one or more of the following technologies to determine orientation: radio frequencies, sound waves, heat sensors, or any other technology known in the art. For example, an exemplary embodiment of an orientation tool 142 may determine the apparatus 100 orientation using the deviation of the wellbore itself if the azimuth is already known.

The centralizer 145 may be identical or substantially similar to one or more of the centralizers 110, 120, and 135. The centralizer 145 is coupled between the bull plug 150 and the tiltmeter 140. The bull plug 150 may be or comprise one or more devices configured to isolate the apparatus 100 from the lower region of the wellbore.

It should be understood that the apparatus 100 may include additional or alternative components other than as shown in FIG. 1*a*, and that the apparatus 100 may also be configured differently and still be within the scope of the present disclosure. For example, it is also possible to integrate the tiltmeter 140 and the orientation tool 142 with the caliper tool 115, thereby eliminating the need for the knuckle joints 125, 130 and the second set of centralizers 135, 145. An example of such a configuration is shown in FIG. 1*b*.

Figure 1B:
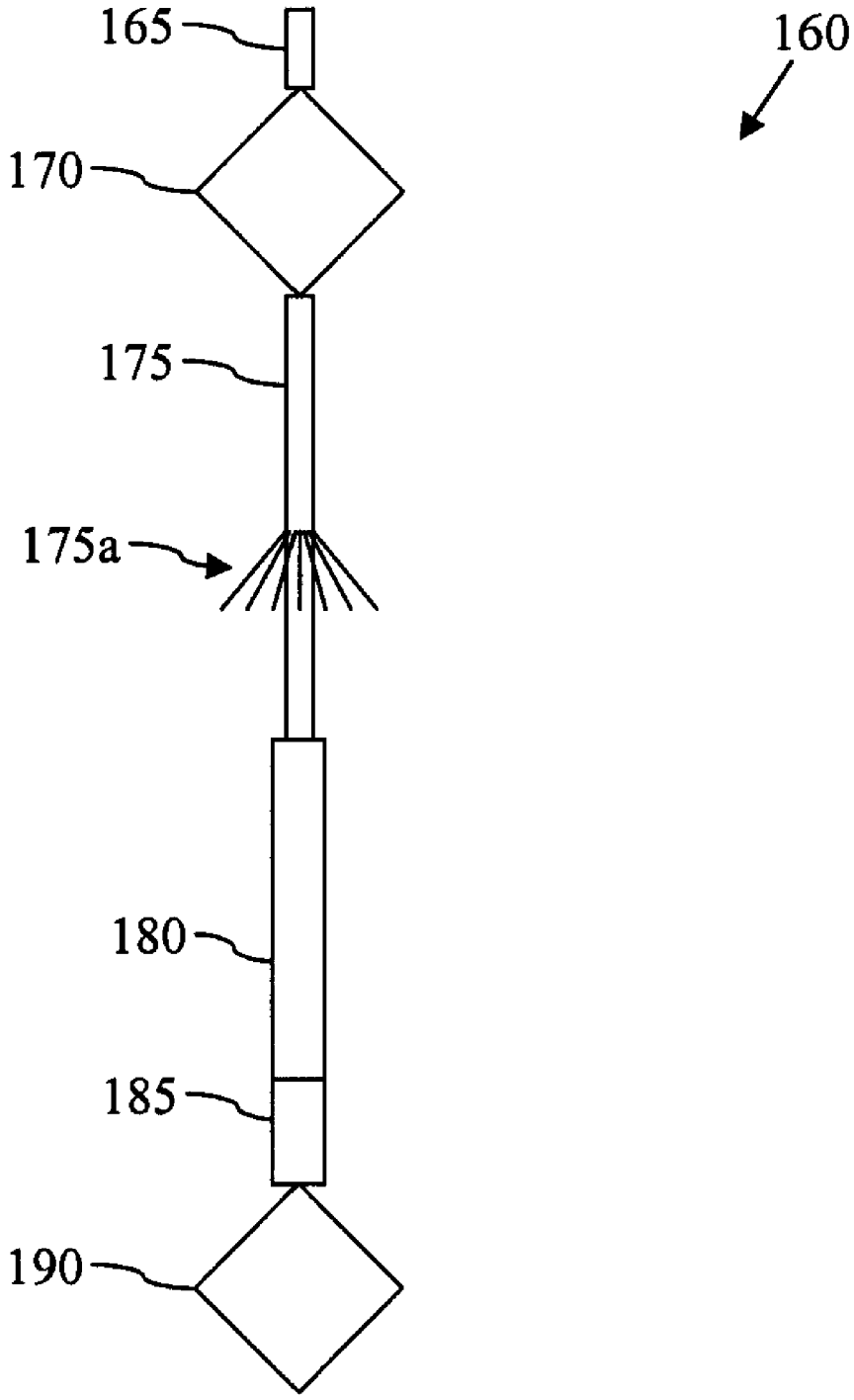
FIG. 1*b* is a schematic view of an apparatus according to one or more aspects of the present disclosure.

Referring now to FIG. 1*b*, with continued reference to FIG. 1*a*, an apparatus 160 may include a wireline head 165, a centralizer 170, a caliper tool 175, a tiltmeter 180, an orientation tool 185, and another centralizer 190. The wireline head 165 may be configured to couple the apparatus 160 within a wireline, slick-line, e-line, or other working string within a wellbore. The wireline head 165 may be coupled to the centralizer 170, and may be identical to or substantially similar to the wireline head 105.

The centralizer 170 may be coupled directly to the wireline head 165. Alternatively, an intermediate component may be coupled between the centralizer 170 and the wireline head 165. The centralizer 170 may be identical to or substantially similar to the centralizer 110.

The caliper tool 175 is coupled between the centralizer 170 and the tiltmeter 180, and may be identical to or substantially similar to the caliper tool 115. The tiltmeter 180 is coupled between the caliper tool 175 and the orientation tool 185, and may be identical or substantially similar to the tiltmeter 140. The orientation tool 185 is coupled between the tiltmeter 180 and the centralizer 190, and may be identical or substantially similar to the orientation tool 142. The centralizer 190 is positioned at the end of the apparatus 160 opposite the wireline head 165 and may be identical or substantially similar to the centralizer 170.

Figure 2:
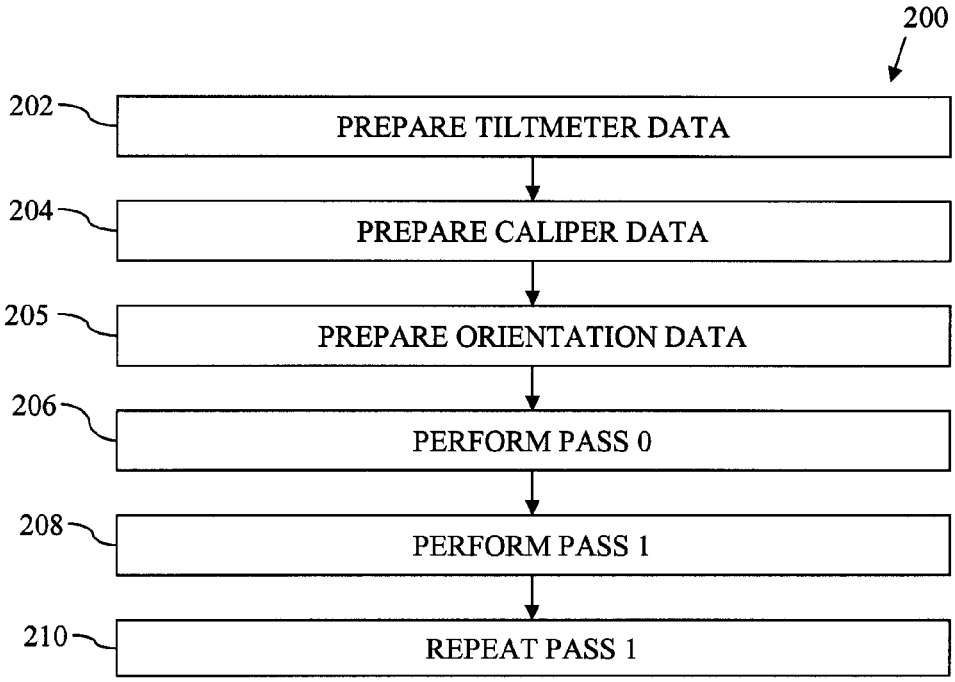
FIG. 2 is a flowchart of at least a portion of a method according to one or more aspects of the present disclosure.

A method demonstrating an exemplary implementation of the apparatus 100 shown in FIG. 1*a* and the apparatus 160 shown in FIG. 1*b* will now be described with reference to FIGS. 2-12 and continued reference to FIG. 1*a*. Referring now to FIG. 2, according to an exemplary embodiment, a method 200 for tracking a wellbore begins with a step 202, wherein tiltmeter data is prepared. Then, in a step 204, caliper data is prepared. Orientation data is prepared in a step 205. Next, in a step 206, an initial pass, referred to as "Pass 0" is performed. Following step 206, in a step 208, a "Pass 1" is performed, and may be repeated one or more times in a step 210. Steps 202, 204, 205, 206, 208 and 210 are described in more detail below with reference to FIGS. 3 and 4, with continued reference to FIG. 2.

Figure 3:
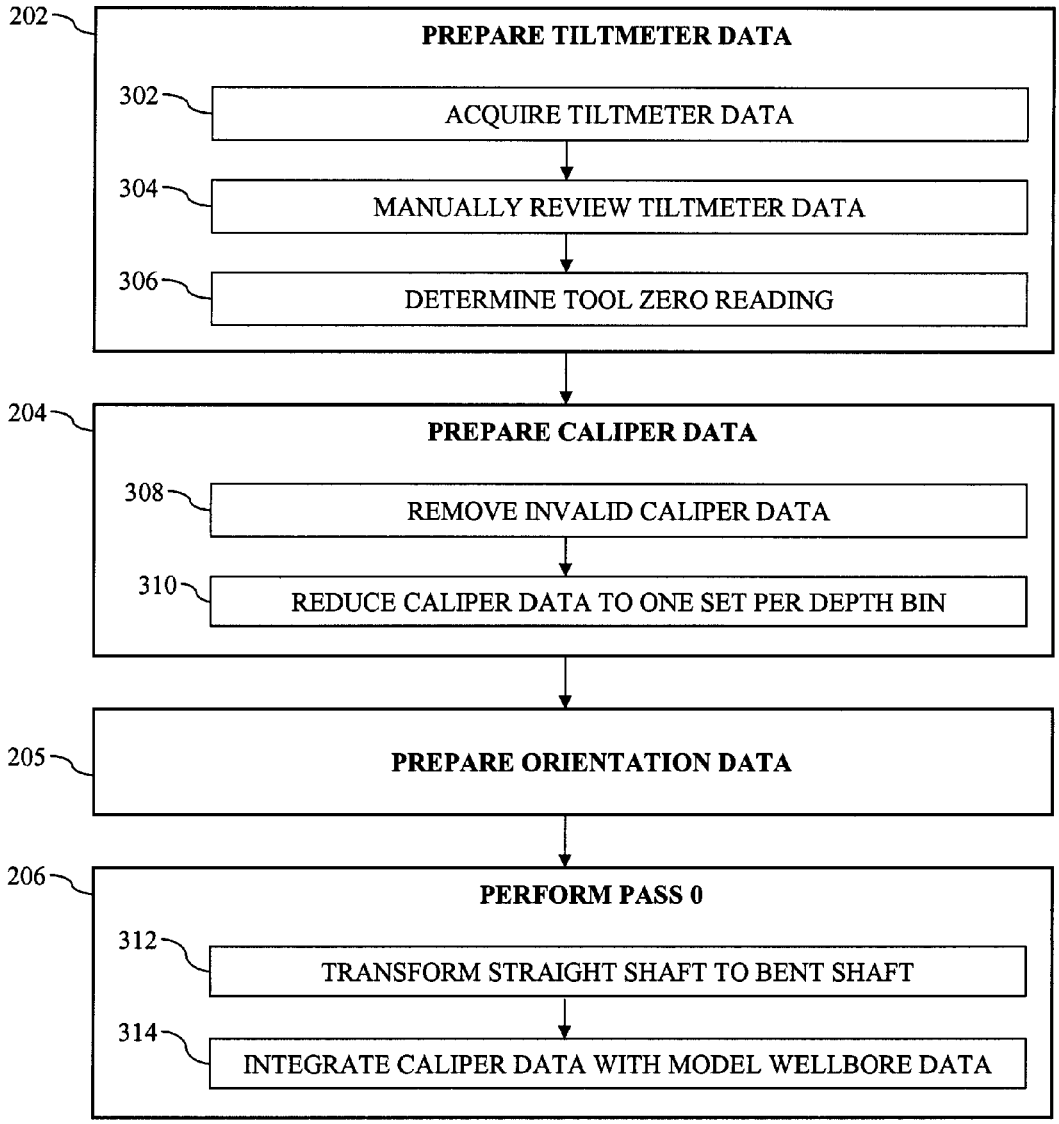
FIG. 3 is a flowchart of at least a portion of a method according to one or more aspects of the present disclosure.

Referring now to FIG. 3, with continued reference to FIG. 1*a*, step 202 is described in more detail. According to an exemplary embodiment, step 202 may include a step 302 for acquiring tiltmeter data, a step 304 for manually reviewing the tiltmeter data, and a step 306 for determining an apparatus zero reading.

In an exemplary embodiment, step 202 includes placing a physical tool, such as the apparatus 100 shown in FIG. 1*a*, within a wellbore. Tool readings from a sufficiently sensitive tiltmeter 140 might change over time, even when the tool is stopped in the well. Thus, according to an exemplary embodiment, tiltmeter readings may be taken over a period of one minute or some other predetermined time period. The tiltmeter 140 may include acquisition software configured to ensure that tiltmeter readings that are taken at a given depth are taken at the same depth each time. Tilt measurements may be made while the tool is stopped at certain depths. In another exemplary embodiment, tilt measurements may be made at certain depths while the tool is in motion, without stopping in the well to obtain a precise measurement. The acquisition software may also include a module configured to suggest the depths for the tilt readings based on collar locations. Ensuring that a centralizer is not on a collar may facilitate the process of repeatedly acquiring accurate tilt readings. According to an exemplary embodiment of the present disclosure, the acquisition software is configured to take more than one tilt reading per casing segment. The acquisition software may be configured to detect anomalous tilt readings, and may repeat tilt data acquisition if the software determines that a reading is anomalous.

Figure 5:
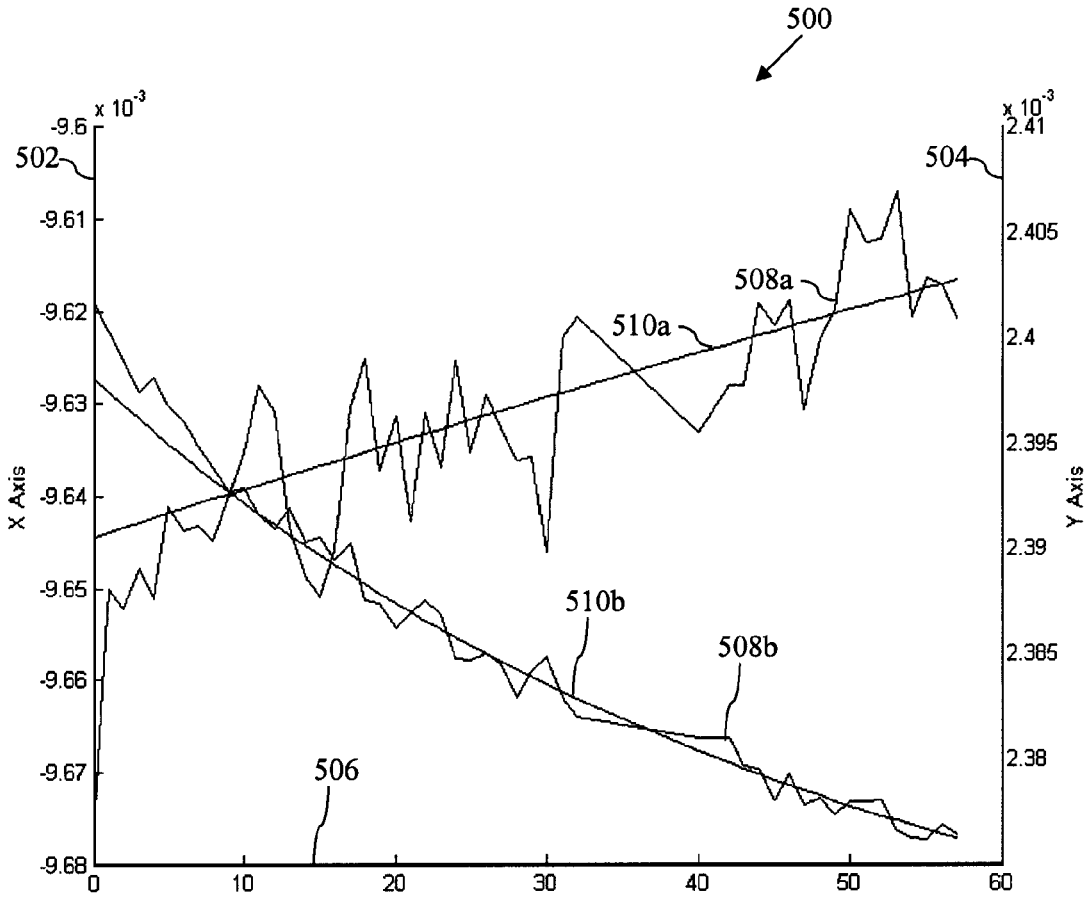
FIG. 5 is a chart according to one or more aspects of the present disclosure.

Referring briefly to FIG. 5, tiltmeter data points may be plotted against a graph 500. According to an exemplary embodiment, the graph 500 includes a first vertical axis 502, a second vertical axis 504, and a horizontal axis 506. The first vertical axis 502 represents tilt along the x-axis of the tool as measured in microradians, and the second vertical axis 504 represents tilt along the y-axis of the tool as measured in microradians. The horizontal axis 506 represents time in seconds. One or more tiltmeter data lines 508*a*, 508*b* may be drawn on the extrapolation graph 500 to connect the tiltmeter data points. Each tiltmeter data line 508*a*, 508*b* connects the tiltmeter data points that correlate to a certain depth.

An extrapolating algorithm may then be used to fit a curve to the tiltmeter data, thereby extrapolating the tiltmeter data out to infinite time. Highly sensitive tilt sensors may take considerable time to approach a steady state reading. In order to speed measurements taken under such conditions, data may be taken for only a limited amount of time prior to fitting an exponential curve to the data to estimate the steady state reading. For example, FIG. 5 shows two extrapolation curves 510*a*, 510*b* fitted against the tiltmeter data lines 508*a*, 508*b*, respectively. Because the tool may experience a settling period, extrapolating the tiltmeter data out to infinite time may be preferred over computing an average tiltmeter measurement over time, because calculating an average that includes such a settling period might produce an inaccurate result.

Returning now to FIG. 3, once tiltmeter readings have been acquired, then in a step 304, a user may manually review the tiltmeter data. One purpose of the manual review is to verify that the tilt of the well from vertical at each measurement is reasonable. If insufficient data is taken, or if the data does not closely follow an expected exponential curve, a new measurement may be required.

After tiltmeter data has been manually reviewed, the tiltmeter data may be input into simulation software. According to an exemplary embodiment of the present disclosure, the simulation software may be configured to execute a step 306 to determine the tool zero reading. The tool zero reading is the tilt signal output when the apparatus 100 is perfectly vertical within a wellbore. Since it may not be practical to place the tool perfectly vertical to get a reading of zero tilt, one method for determining the tool zero may use many readings from one or more depths in the wellbore to determine the tool reading when perfectly vertical. For example, two depths may be chosen, wherein the depths are separated by sufficient distance such that the instrument naturally rotates as it is raised and lowered between the two depths. The readings at each depth, may then be plotted on a graph as tilt in the East direction and tilt in the North direction. A circle may then be fitted to the plotted points. The center of the circle represents the reading of the tool when it is perfectly vertical. At a minimum, two readings at a single depth but different tool orientations, along with knowledge of the tool orientation for each reading, may be sufficient to determine the tool zero reading. However, a multitude of readings, may be used. For example, according to one exemplary embodiment, ten (10) to twenty (20) readings are used. Using a multitude of readings may provide a better understanding of any variation in tilt measurements.

Figure 6:
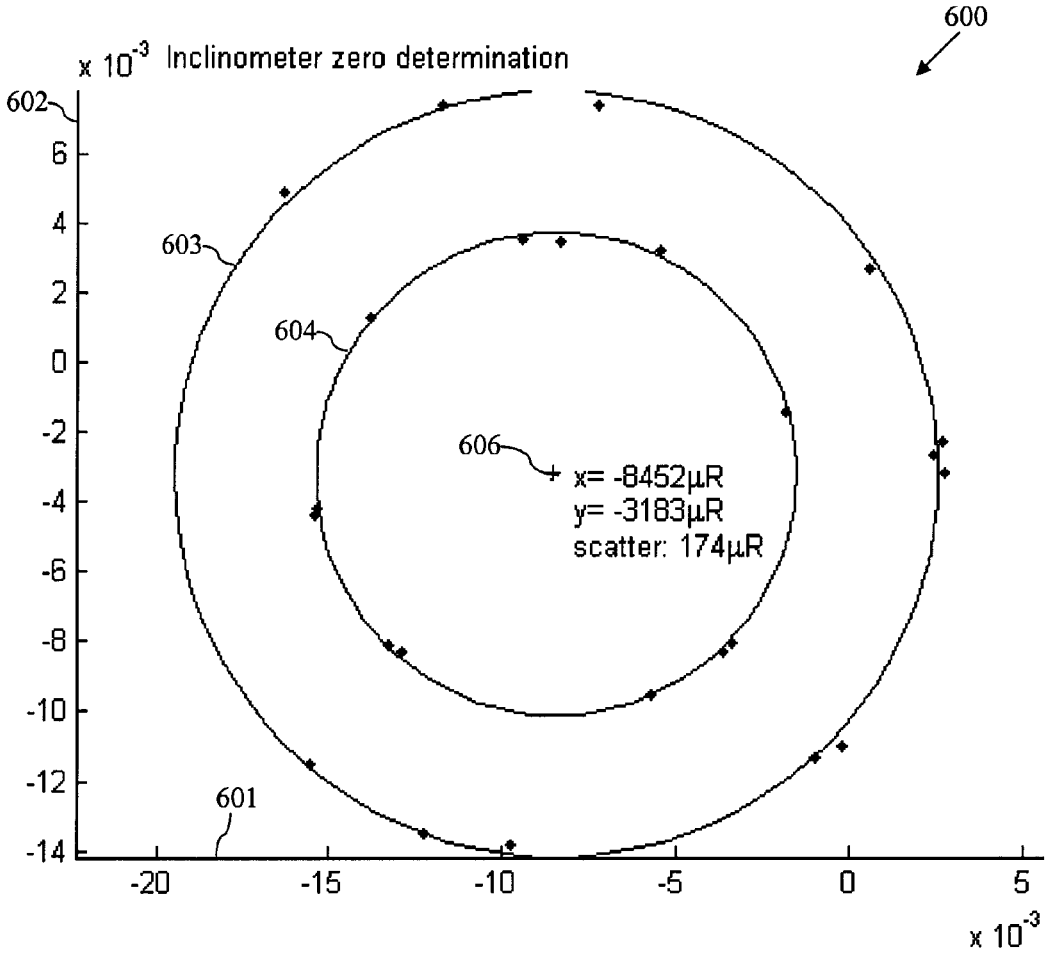
FIG. 6 is a chart according to one or more aspects of the present disclosure.

Referring to FIG. 6, illustrated is a graph 600 that may be used to determine the tool zero reading. According to an exemplary embodiment, the x-axis 601 and the y-axis 602 of the graph 600 represent deviation from a center coordinate (0, 0) as measured in microradian units. According to an exemplary embodiment, the extrapolation curves 510*a*, 510*b* from the graph 500 are mapped to the graph 600.

After the tiltmeter data from each depth is mapped to the graph 600, one or more circles may be fitted to the tiltmeter data. As shown in FIG. 6, graph 600 maps tiltmeter data taken at two different depths. Accordingly, the graph 600 includes an outer circle 603 fitted to data taken at a first depth, and an inner circle 604 fitted to data taken at a second depth. A center point 606 of the outer circle 603 and inner circle 604 represents the reading of the tool when perfectly vertical. For example, as shown in the graph 600, the tool zero reading is determined to be at −8452 microradians along the x coordinate and −3183 microradians along the y coordinate. The tool zero reading may then be used to calibrate tiltmeter data.

According to an exemplary embodiment, the tool zero reading must be determined each time a tool is reassembled, because the tool zero reading changes each time a tool is reassembled.

Referring back to FIG. 3, the simulation may then prepare caliper data in accordance with an embodiment of the step 204. It is possible that one of the calipers of the caliper tool may malfunction, and thereby introduce invalid data into a caliper dataset. Thus, in an exemplary embodiment, invalid data is removed from the caliper dataset in a step 308. According to an exemplary embodiment, the step 308 may be a semi-automated process. For example, one or more software algorithms may be configured to identify invalid caliper data.

In an exemplary embodiment of the present disclosure, the caliper data may include nearly six thousand (6,000) caliper measurements per foot of depth. This amount of data may be too large for some computers to timely process. Thus, according to an exemplary embodiment, in a step 310, the simulation may reduce the caliper data to one set of readings per depth bin. In an exemplary embodiment, step 310 includes reducing the caliper dataset to one set of readings per one centimeter (1 cm.) of depth. An operator may set the depth bin depending on the processing power of a computer configured to process the caliper dataset. Using a smaller depth bin may result in more accurate results, but may also require more processing power because of the larger amount of data that must be processed.

According to an exemplary embodiment, after tiltmeter data has been calibrated and the caliper data has been prepared, then orientation data is prepared in a step 205. Step 205 may include orienting the calibrated tiltmeter data and the caliper data with tool orientation data collected by an orientation tool at various depths within a wellbore. It should be understood that the step 205 could also be performed as part of step 202 and/or step 204.

Next, the simulation processes the oriented tiltmeter and caliper data by performing a series of simulation passes. Pass 0 is the first of these simulation passes, and occurs in the step 206. According to an exemplary embodiment, in a step 312, the simulation generates a bent shaft model wellbore by integrating the oriented tiltmeter data with a straight shaft model wellbore. The resulting bent shaft model wellbore provides a rough estimate of model wellbore deformation along the length of the model wellbore.

Figure 7A:
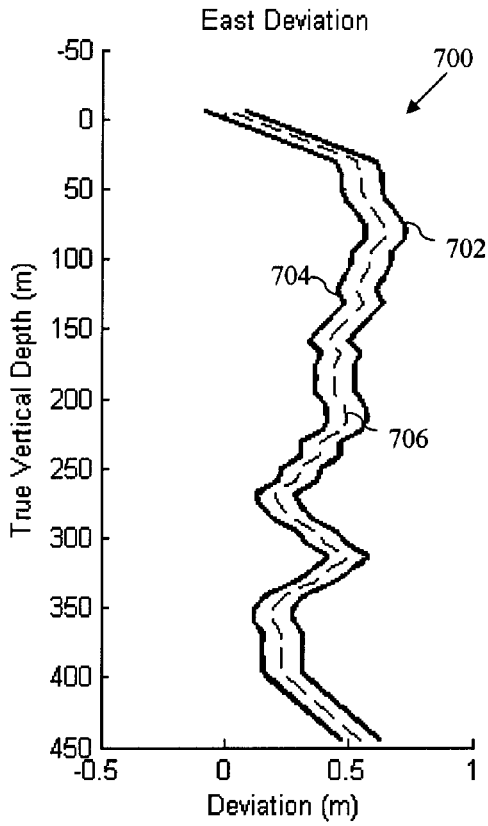
FIGS. 7A and 7B are charts according to one or more aspects of the present disclosure.
Figure 7B:
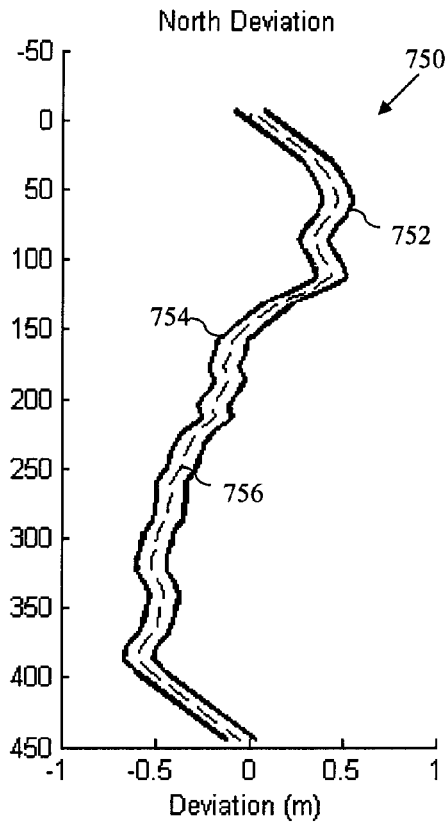

Referring now to FIGS. 7A and 7B, two graphs 700 and 750 graphically represent oriented tiltmeter data applied to a bent shaft model wellbore in two dimensions. According to an exemplary embodiment, both graphs 700 and 750 include a x-axis that represents deformation as measured in meters, and a y-axis that represents true vertical depth as measured in meters. The graph 700 shows a rough estimate of model wellbore vertical deviation from a side perspective. Model wellbore lines 702, 704 show a rough estimate of the edges of the model wellbore from the side perspective. Model wellbore centerline 706 shows a rough estimate of the model wellbore centerline from the side perspective. The graph 750 shows a rough estimate of model wellbore deformation from a front perspective. Model wellbore lines 752 and 754 show a rough estimate of the edges of the model wellbore from the front perspective. Model wellbore centerline 756 shows a rough estimate of the model wellbore centerline from the front perspective.

Referring now to FIGS. 8A and 8B, two graphs 800 and 850 represent oriented caliper data applied to a bent shaft model wellbore in three dimensions. The graph 800 is a side view that shows the model tool situated within a portion of the model wellbore. FIG. 8B shows a graph 850 that is a front view of the same. According to an exemplary embodiment, the graphs 800, 850 include an x-axis that represents deviation from the tool zero reading as measured in meters and a y-axis that represents true vertical depth as measured in meters. The model centralizers 802 represent the position of the centralizer 110 of a model tool situated within the model wellbore.

In an exemplary embodiment, the model tool is based on the apparatus 100. The model caliper arms or fingers 804 represent the position of the caliper arms or fingers 115*a* of the model tool within the model wellbore. The model centralizers 806 represent the position of the centralizer 120 of the model tool within the model wellbore. The model centralizers 808 represent the position of the centralizer 135 of the model tool within the model wellbore. Finally, the model centralizers 810 represent the position of the centralizer 145 of the model tool within the model wellbore.

Figure 9A:
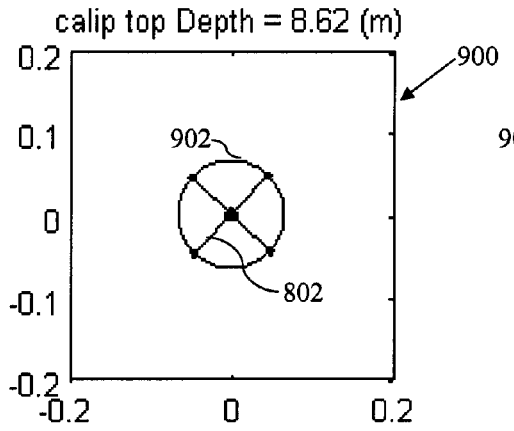
FIGS. 9A and 9B are charts according to one or more aspects of the present disclosure.

FIG. 9A shows a graph 900 representing the orientation of a top caliper model centralizer 910 within a model wellbore at a depth of 8.62 meters. According to an exemplary embodiment, the model top caliper centralizer 802 corresponds to the centralizer 110. The graph 900 includes a x-axis that represents position in the x-direction and a y-axis that represents position in the y-direction of a model wellbore. The graph 900 also shows the angular orientation of the model top caliper centralizer 802. Profile line 902 shows a diameter or other profile of the model wellbore at a depth of 8.62 meters.

Figure 9B:
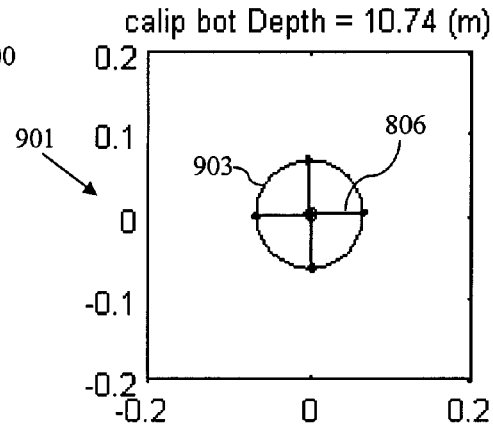

FIG. 9B shows a graph 901 representing the orientation of a model bottom caliper centralizer 806 within a model wellbore at a depth of 10.74 meters. According to an exemplary embodiment, the model bottom caliper centralizer 806 corresponds to the centralizer 120. The graph 901 includes an x-axis that represents position in the x-direction and a y-axis that represents position in the y-direction of a model wellbore. The graph 901 also shows the angular orientation of the model bottom caliper centralizer 806. Profile line 903 shows a diameter or other profile of the model wellbore at a depth of 10.74 meters. The angular orientation of the model bottom caliper centralizer 806 is shown in FIG. 9B to have one side that is substantially due north, or about 45° relative to the model top caliper centralizer 802 at depth of 8.62 meters, which is shown in FIG. 9A to be angled at an offset from due north.

Figure 10A:
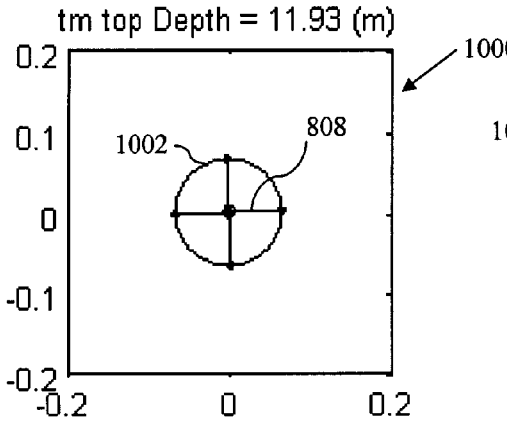
FIGS. 10A and 10B are charts according to one or more aspects of the present disclosure.

FIG. 10A shows a graph 1000 representing the orientation of a model top tiltmeter centralizer 808 within a model wellbore at a depth of 11.93 meters. The graph 1000 includes an x-axis that represents position in the x-direction and a y-axis that represents position in the y-direction of a model wellbore. According to an exemplary embodiment, the model top tiltmeter centralizer 808 corresponds to the centralizer 135.

Figure 10B:
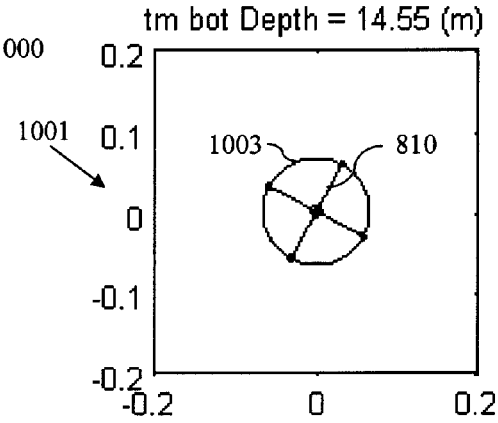

FIG. 10B shows a graph 1001 representing the orientation of a model bottom tiltmeter centralizer 810 within a model wellbore at a depth of 14.55 meters. According to an exemplary embodiment, the model bottom tiltmeter centralizer 810 corresponds to the centralizer 145. The graph 1001 includes an x-axis that represents position in the x-direction and a y-axis that represents position in the y-direction of a model wellbore. The angular orientation of the model top tiltmeter centralizer 808 at depth 11.93 meters is shown in FIG. 10A to have one side that is substantially due north, or about 45° relative to the model bottom tiltmeter centralizer 810 at depth of 14.55 meters, which is shown in FIG. 10B to be angled at an offset from due north.

Figure 11:
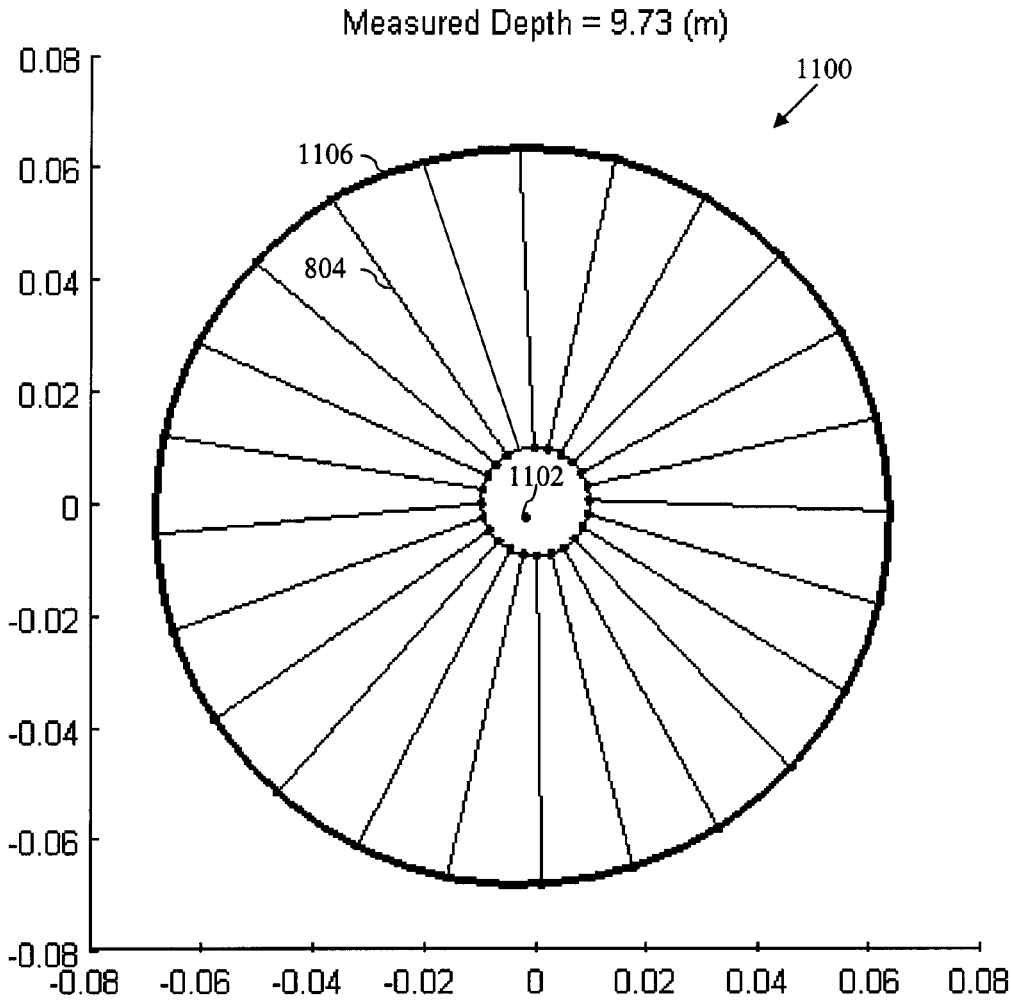
FIG. 11 is a chart according to one or more aspects of the present disclosure.

FIG. 11 shows a graph 1100 that illustrates a cross-section view of the caliper arms 804 situated within the model wellbore at a depth of 9.73 meters according to the oriented caliper dataset. The graph 1100 includes an x-axis and a y-axis that represent distance from a model wellbore centerline 1102. In the graph 1100, the model wellbore centerline 1102 is coordinate (0, 0). The graph 1100 shows a mapping of a caliper arm readings related to caliper arms 804. According to an exemplary embodiment, the caliper arm readings reflect the angular deflection of a caliper arm and, therefore, diameter of the model wellbore. After the caliper arm readings for all of the caliper arms are mapped on the graph 1100, a circle 1106 may be fitted to the caliper arm readings. The circle 1106 represents the profile or inner diameter and/or the deformation of the model wellbore.

Referring once again to FIG. 3, according to an exemplary embodiment, the simulation integrates the oriented caliper data into the bent shaft model wellbore in a step 314. In an exemplary embodiment, integrating oriented caliper data into the model wellbore includes simulating the position of a model tool within a model wellbore at various depths along the model wellbore centerline. The simulated position of the model tool may reflect the orientation of the model within the model wellbore. According to one embodiment, the step 314 begins by simulating the position of a model tool at the top of the model wellbore. The simulation then simulates the position of the model tool at various depths along the model wellbore. According to an exemplary embodiment, the depth interval between depth changes is one centimeter (1 cm), and the simulation simulates the descent of the model tool within the model wellbore. At each depth, if the model wellbore deformation data does not agree with the deformation data measurements of the oriented caliper data, the simulation adjusts the deformation of the model wellbore at the current depth so that it agrees with the oriented caliper data.

To clarify, the simulation may process the model wellbore deformation data in any desired order. For example, according to another exemplary embodiment, the step 314 begins by simulating the placement of the model tool at the bottom of the model wellbore, and simulates the position of the model tool at various depths along the model wellbore while simulating upward movement of the model tool within the model wellbore. In yet another exemplary embodiment, the simulation may process the model wellbore deformation data in a random order. That is, the step 314 may begin by simulating the placement of the model tool at a random depth along the model wellbore, and may continue to process the model wellbore deformation data with respect to other unprocessed random depths until all model wellbore deformation data has been processed.

According to an exemplary embodiment, the location of the model tool within the model wellbore is assumed to coincide with the wellbore centerline during Pass 0. Thus, although the model wellbore may include oriented tiltmeter and caliper data at the end of pass 0, the model wellbore data may not be fully consistent with measured tiltmeter and caliper data. In another embodiment, after the simulation completes Pass 0, one or more additional simulations are performed. These additional passes may refine the shape of the model wellbore to minimize differences between the modeled and measured data sets at all tool locations.

Figure 4:
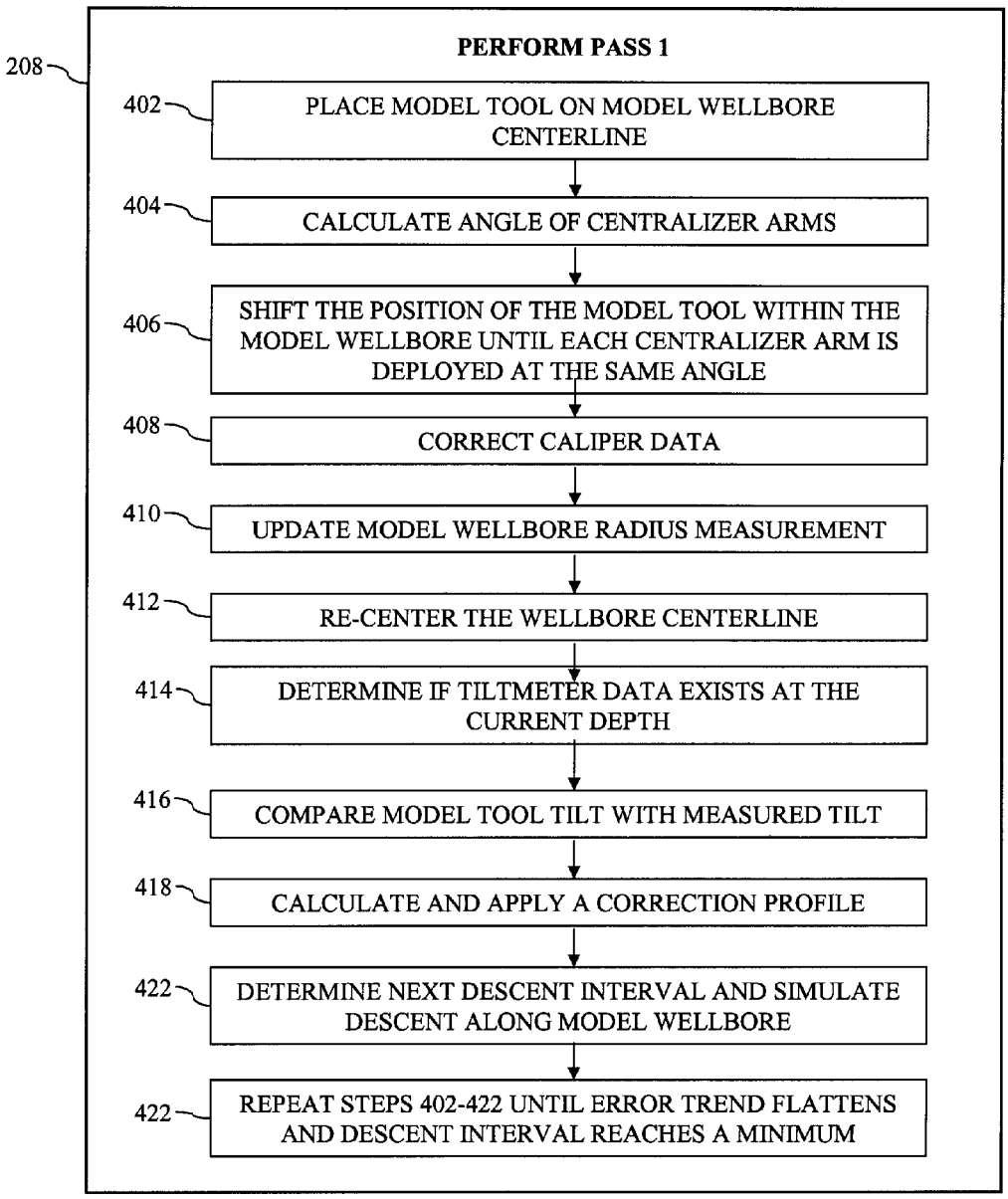
FIG. 4 is a flowchart of at a least a portion of a method according to one or more aspects of the present disclosure.

After Pass 0, the simulation may execute a Pass 1 in accordance with an embodiment of step 208. In Pass 1, the simulation calculates the precise tool position at each depth in the wellbore in order to ensure the model wellbore is consistent with the oriented caliper and tiltmeter data. Referring now to FIG. 4, according to an exemplary embodiment of the present disclosure, step 208 includes a step 402 where the simulation places the model tool within the model wellbore, and aligns the model tool with the model wellbore centerline. Then, in a step 404, the simulation calculates the deflection angle of each model centralizer arm against the casing of the model wellbore as measured from the axis of the model tool. Next, in a step 406, the simulation shifts the position of the model tool until each centralizer arm is deployed at the same angle. The simulation then corrects the caliper readings using a measurement of the model wellbore radius as measured from the model wellbore centerline in a step 408, and updates the model wellbore radius measurements for each arm depth and angle in a step 410. The simulation then re-centers the model wellbore centerline of the model wellbore casing to reflect the corrections in a step 412.

In a step 414, the simulation determines whether the oriented tiltmeter data includes the tilt measurements that correspond to the current depth. If yes, then in a step 416, oriented tilt measurements at the corresponding depth are compared to the tilt of the model tool as determined by the simulation. If the oriented tiltmeter data does not correlate to the simulation's calculated tilt of the model tool, the simulation determines a correction to be applied to the model wellbore in a step 418.

There are numerous conventional ways to determine the correction that the simulation should apply to the model wellbore. According to an exemplary embodiment, the simulation uses the tilt error to calculate a correction profile for the model wellbore based on the average of two methods: 1) spline fit correction with no shift in the model wellbore center position, and 2) linear correction of tilt from zero at the depth of the oriented tiltmeter data above the current depth to the required value at the current model tool depth and back to zero at the depth of the next tilt reading.

Figure 12:
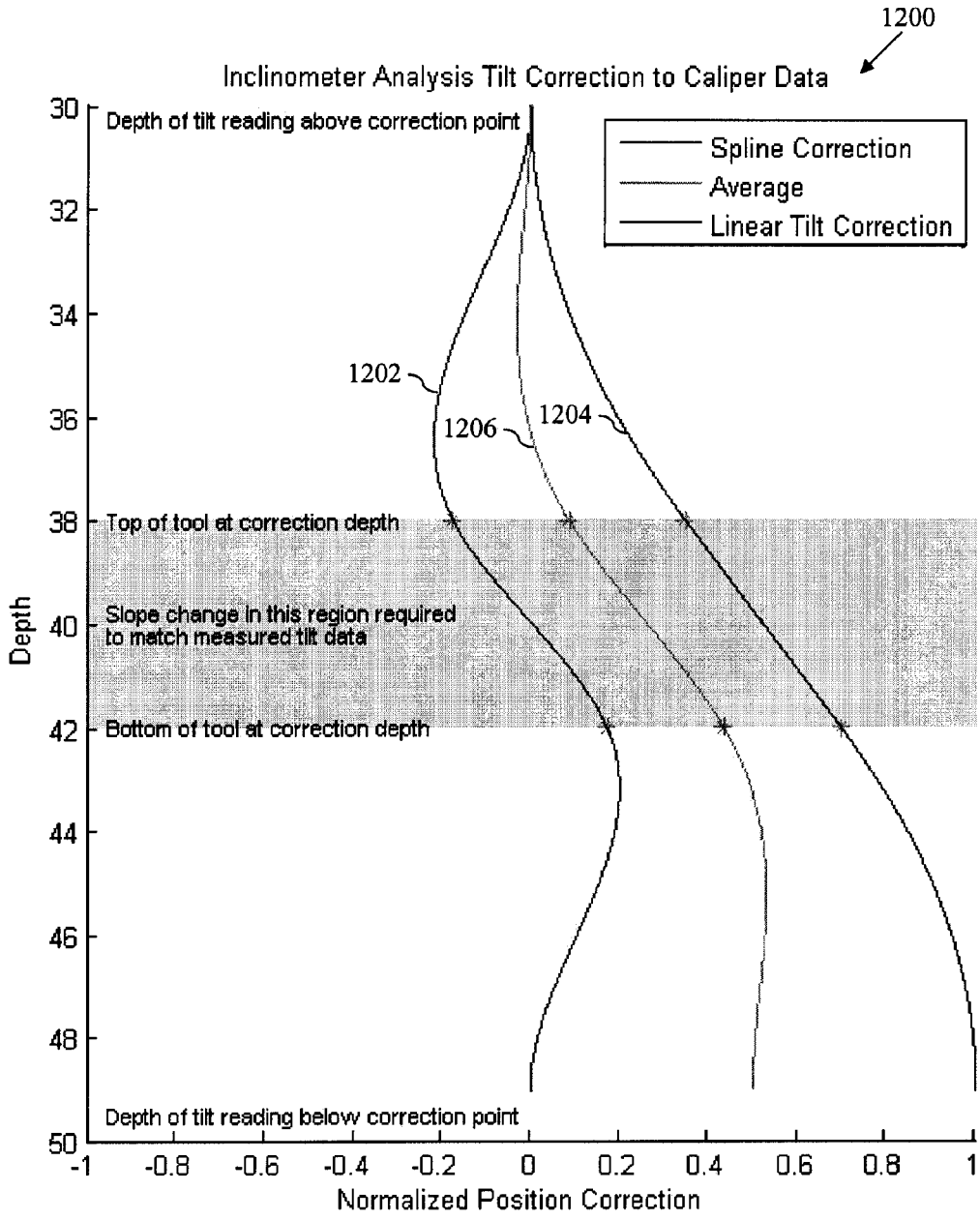
FIG. 12 is a chart according to one or more aspects of the present disclosure.

Referring to FIG. 12, a correction profile may be calculated using the average of a spline fit correction and a linear correction. The graph 1200 includes an x-axis that represents normalized position correction and a y-axis that represents the depth of the tool as measured in meters. First, tilt correction data is mapped to the graph 1200. Then a spline curve 1202 is fitted against the tilt correction data, and a linear tilt curve 1204 is fitted against the tilt correction data. An average curve 1206 is then fitted to the average of the spline curve 1202 and the linear tilt curve 1204.

Referring again to FIG. 4, after a correction profile has been calculated, the simulation applies corrections to the model wellbore as part of the step 418. Then in a step 420, the simulation determines the next depth interval and simulates the position of the model tool within the model wellbore at the next depth. The simulation may use a predetermined depth interval unless large changes in the model wellbore deviation or deformation indicate that a different depth interval should be used.

The amount of correction at each depth of a model wellbore reflects a data mismatch between the oriented caliper data and the oriented tiltmeter data. Each time a correction is applied to the model wellbore, the model wellbore changes shape and position. Thus, the model tool position calculations as determined by the simulation during a previous pass become inconsistent with the corrected model wellbore. Because model tool position calculations are inconsistent, model wellbore radius and model tool tilt calculations, as determined by the simulation during a previous pass, are also inconsistent with the corrected model wellbore.

To correct inconsistencies, in an exemplary embodiment of the present disclosure, once the simulation reaches a point where the bottom of the model tool reaches a final depth of the model wellbore, the simulation initiates another pass in accordance with a step 422, wherein the simulation repeats steps 402-422. Steps 402-422 may be repeated in additional simulation passes until the model wellbore no longer requires any further corrections—that is, the model wellbore reflects the oriented tiltmeter dataset as integrated with the oriented caliper dataset. In an exemplary embodiment of the present disclosure, during the additional simulation passes, the simulation keeps track of the amount of correction applied at each tilt measurement depth and the maximum amount of model wellbore movement at any location from the previous run. When the error trend (as determined by the maximum amount of model wellbore movement from the previous run) flattens, the simulation decreases the maximum depth interval. In an exemplary embodiment, the simulation stops performing additional passes once the depth interval reaches a predetermined minimum and the error trend has flattened. For example, in an exemplary embodiment, the minimum depth interval is one centimeter (1 cm.).

Figure 13:
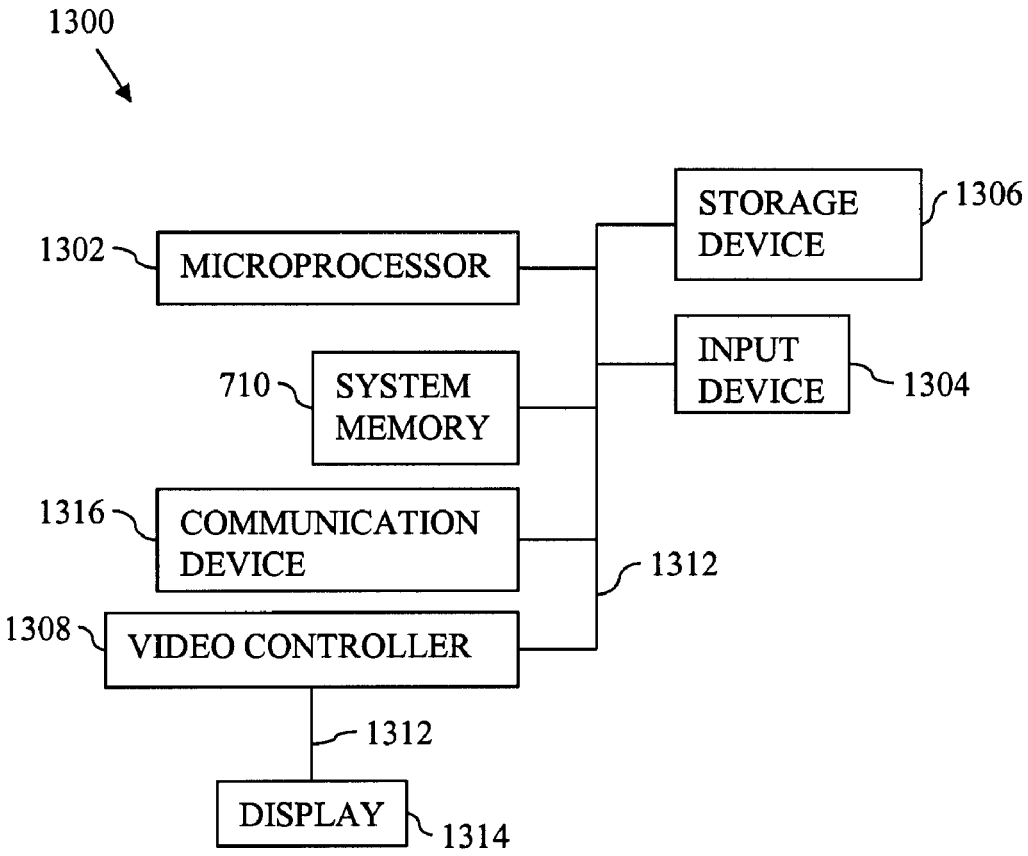
FIG. 13 is a schematic view of a system according to one or more aspects of the present disclosure.

It will be understood by those having skill in the art that one or more (including all) of the elements/steps of the present invention may be implemented using software executed on a general purpose computer system or networked computer systems, using special purpose hardware based computer systems, or using combinations of special purpose hardware and software. Referring to FIG. 13, an illustrative node 1300 for implementing an embodiment of the methods of the present disclosure is depicted. Node 1300 includes a microprocessor 1302, an input device 1304, a storage device 1306, a video controller 1308, a system memory 1310, a display 1314, and a communication device 1316 all interconnected by one or more buses 1312. The storage device 1306 could be a floppy drive, hard drive, CD-ROM, optical drive, or any other form of storage device. In addition, the storage device 1306 may be capable of receiving a floppy disk, CD-ROM, DVD-ROM, or any other form of computer-readable medium that may contain computer-executable instructions. Further, communication device 1316 could be a modem, network card, or any other device to enable the node to communicate with other nodes. It is understood that any node could represent a plurality of interconnected (whether by intranet or Internet) computer systems, including without limitation, personal computers, mainframes, PDAs, and cell phones.

A computer system typically includes at least hardware capable of executing machine readable instructions, as well as the software for executing acts (typically machine-readable instructions) that produce a desired result. In addition, a computer system may include hybrids of hardware and software, as well as computer sub-systems.

Hardware generally includes at least processor-capable platforms, such as client-machines (also known as personal computers or servers), and hand-held processing devices (such as smart phones, personal digital assistants (PDAs), or personal computing devices (PCDs), for example). Further, hardware may include any physical device that is capable of storing machine-readable instructions, such as memory or other data storage devices. Other forms of hardware include hardware sub-systems, including transfer devices such as modems, modem cards, ports, and port cards, for example.

Software includes any machine code stored in any memory medium, such as RAM or ROM, and machine code stored on other devices (such as floppy disks, flash memory, or a CD ROM, for example). Software may include source or object code, for example. In addition, software encompasses any set of instructions capable of being executed in a client machine or server.

Combinations of software and hardware could also be used for providing enhanced functionality and performance for certain embodiments of the disclosed invention. One example is to directly manufacture software functions into a silicon chip. Accordingly, it should be understood that combinations of hardware and software are also included within the definition of a computer system and are thus envisioned by the invention as possible equivalent structures and equivalent methods.

Computer-readable mediums include passive data storage, such as a random access memory (RAM) as well as semi-permanent data storage such as a compact disk read only memory (CD-ROM). In addition, an embodiment of the invention may be embodied in the RAM of a computer to transform a standard computer into a new specific computing machine.

Data structures are defined organizations of data that may enable an embodiment of the invention. For example, a data structure may provide an organization of data, or an organization of executable code. Data signals could be carried across transmission mediums and store and transport various data structures, and, thus, may be used to transport an embodiment of the invention.

The system may be designed to work on any specific architecture. For example, the system may be executed on a single computer, local area networks, client-server networks, wide area networks, internets, hand-held and other portable and wireless devices and networks.

A database may be any standard or proprietary database software, such as Oracle, Microsoft Access, SyBase, or DBase II, for example. The database may have fields, records, data, and other database elements that may be associated through database specific software. Additionally, data may be mapped. Mapping is the process of associating one data entry with another data entry. For example, the data contained in the location of a character file can be mapped to a field in a second table. The physical location of the database is not limiting, and the database may be distributed. For example, the database may exist remotely from the server, and run on a separate platform. Further, the database may be accessible across the Internet. Note that more than one database may be implemented.

Figure 14:
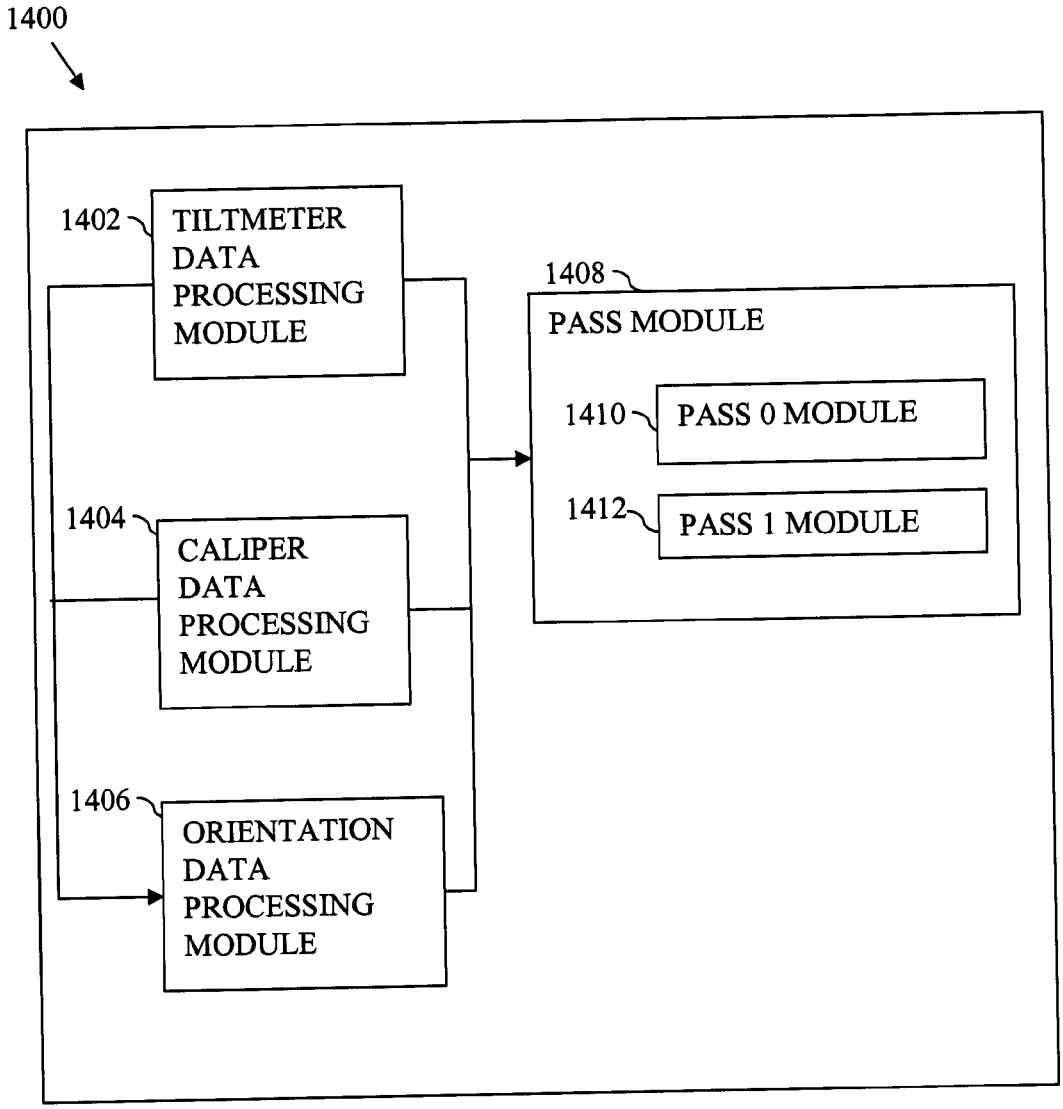
FIG. 14 is a schematic view of a system configured to implement a method according to one or more aspects of the present disclosure.

Referring now to FIG. 14 with continued reference to FIG. 2, shown is a system 1400 embodying one or more aspects of the present disclosure. According to an exemplary embodiment, the system 1400 includes a tiltmeter data processing module 1402 configured to execute step 202 of the method 200. Further, an embodiment of the system 1400 includes a caliper data processing module 1404 configured to execute step 204 of the method 200. The system 100 may also include an orientation data processing module 1406 configured execute step 205 of the method 200. The system 1400 also includes a pass module 1408 that includes a pass 0 module 1410 configured to execute step 206 of the method 200, and a pass 1 module 1412 configured to execute steps 208-210 of the method 200.

An exemplary embodiment of the present disclosure may combine a caliper with an electrolytic tiltmeter and a magnetic compass for orientation. By measuring casing deformation with the caliper, one can determine the deviation of a short section of casing. At periodic stations, the tool stops so a tilt measurement can be made. According to another exemplary embodiment, tilt measurements may be made without stopping the tool. The tilt measurement is used to recalibrate the caliper-derived wellbore deviation, thereby reducing or removing accumulated errors from the double integration process. The number of tilt measurements taken is a trade off between the desired accuracy and the time required to log the wellbore. An aspect of the present disclosure is the analysis of the data, which tightly integrates the tilt measurements with the caliper measurements. It is possible to develop a wellbore deviation survey from either of the two instruments alone, but a more accurate result may be obtained by considering both sets of data in the analysis. Other wellbore measurement tools may not provide the accuracy available from this tool. Most also do not measure casing deformation.

Products and services which may implement embodiments of the present disclosure include wellbore deformation and deviation tracking over the life of a wellbore. For example, such products and services may include providing important measurements that can be used to constrain a reservoir model, or the ability to more precisely locate wells in a field.

In view of all of the above and the figures, it should be readily apparent to those skilled in the art that the present disclosure introduces a method for developing a wellbore deviation survey comprising collecting wellbore deformation data using a caliper at each of a plurality of depths within the wellbore, collecting wellbore deviation data at ones of the plurality of depths, collecting tool orientation data using an orientation tool at ones of the plurality of depths, orienting the wellbore deformation data and the wellbore deviation data with the tool orientation data, and determining simulated wellbore deformation and deviation data using the oriented wellbore deformation data. A wellbore deviation survey is then developed by calibrating the simulated wellbore deviation data based on the oriented wellbore deviation data.

Determining the simulated wellbore deviation data and developing the wellbore deviation survey may comprise simulating a position of a model tool at each of a plurality of simulation depths along the length of a model wellbore to generate simulated wellbore deformation data at each of the plurality of simulation depths and simulated wellbore deviation data at ones of the plurality of simulation depths, wherein each of the plurality of simulation depths corresponds to one of the plurality of depths within the wellbore. Simulated wellbore deviation data is then determined using the generated simulated wellbore deformation data, and the simulated wellbore deviation data is then adjusted based on the simulated wellbore deviation data at ones of the plurality of simulation depths where the simulated wellbore deviation or deformation data does not agree with the oriented wellbore deviation and deformation data.

The present disclosure also provides a system for developing a wellbore deviation survey. In an exemplary embodiment, the system comprises means for collecting wellbore deformation data using a caliper at each of a plurality of depths within the wellbore, means for collecting wellbore deviation data at ones of the plurality of depths, means for collecting tool orientation data using an orientation tool at ones of the plurality of depths, means for orienting the wellbore deformation data and the wellbore deviation data with the tool orientation data, and means for determining simulated wellbore deformation and deviation data using the oriented wellbore deformation data. The system also comprises means for developing a wellbore deviation survey by calibrating the simulated wellbore deviation data based on the oriented wellbore deviation data.

The means for determining the simulated wellbore deviation data and the means for developing the wellbore deviation survey may comprise means for simulating a position of a model tool at each of a plurality of simulation depths along the length of a model wellbore to generate simulated wellbore deformation data at each of the plurality of simulation depths and simulated wellbore deviation data at ones of the plurality of simulation depths, wherein each of the plurality of simulation depths corresponds to one of the plurality of depths within the wellbore. The means for determining the wellbore deviation data and the means for developing the wellbore deviation survey may further comprise means for determining simulated wellbore deviation data using the generated simulated wellbore deformation data, and means for adjusting the simulated wellbore deviation data based on the simulated wellbore deviation data at ones of the plurality of simulation depths where the simulated wellbore deformation or deviation data does not agree with the oriented wellbore deformation and deviation data.

An exemplary embodiment of a system for developing a wellbore deviation survey within the scope of the present disclosure comprises a module configured to collect wellbore deformation data using a caliper at each of a plurality of depths within the wellbore, a module configured to collect wellbore deviation data using a tiltmeter at ones of the plurality of depths, a module configured to collect tool orientation data using an orientation tool at ones of the plurality of depths, a module configured to orient the wellbore deformation data and the wellbore deviation data with the tool orientation data, and a module configured to determine simulated wellbore deviation data using the oriented wellbore deformation data. The system may further comprise a module configured to develop a wellbore deviation survey by calibrating the simulated wellbore deviation data based on the oriented wellbore deviation data.

The module for determining the wellbore deviation data and the module for developing the wellbore deviation survey may be configured to simulate a position of a model tool at each of a plurality of simulation depths along the length of a model wellbore to generate simulated wellbore deformation data at each of the plurality of simulation depths and simulated wellbore deviation data at ones of the plurality of simulation depths, wherein each of the plurality of simulation depths corresponds to one of the plurality of depths within the wellbore. The module for developing the wellbore deviation survey may further be configured to determine simulated wellbore deviation data using the generated simulated wellbore deformation data, and adjust the simulated wellbore deviation data based on the simulated wellbore deviation data at ones of the plurality of simulation depths where the simulated wellbore deformation or deviation data does not agree with the oriented wellbore deformation and deviation data.

The present disclosure also introduces a computer program product embodied on a computer-usable medium, the medium having stored thereon a sequence of instructions which, when executed by a processor, causes the processor to execute a method for wellbore tracking, the method comprising: collecting wellbore deformation data using a caliper at each of a plurality of depths within the wellbore; collecting wellbore deviation data using a tiltmeter at ones of the plurality of depths; collecting tool orientation data using an orientation tool at ones of the plurality of depths; orienting the wellbore deformation data and the wellbore deviation data with the tool orientation data; determining simulated wellbore deformation and deviation data using the oriented wellbore deformation data; and developing a wellbore deviation survey by calibrating the simulated wellbore deviation data based on the oriented wellbore deviation data.

Determining the simulated wellbore deviation data and developing the wellbore deviation survey may comprise: simulating a position of a model tool at each of a plurality of simulation depths along the length of a model wellbore to generate simulated wellbore deformation data at each of the plurality of simulation depths and simulated wellbore deviation data at ones of the plurality of simulation depths, wherein each of the plurality of simulation depths corresponds to one of the plurality of depths within the wellbore; determining simulated wellbore deviation data using the generated simulated wellbore deformation data; and adjusting the simulated wellbore deviation data based on the simulated wellbore deviation data at ones of the plurality of simulation depths where the simulated wellbore deformation data does not agree with the oriented wellbore deformation data.

An apparatus for collecting wellbore deformation and wellbore deviation data is also provided in the present disclosure. In an exemplary embodiment, the apparatus comprises a first tool configured to collect wellbore deformation data in-situ at each of a plurality of depths within the wellbore, a second tool coupled to the first tool and configured to collect wellbore deviation data in-situ at ones of the plurality of depths, and a third tool coupled to either the first or second tool and configured to collect orientation data in-situ at ones of the plurality of depths. The first tool may comprise a caliper tool. The second tool may comprise a tiltmeter. The third tool may comprise a magnetic compass. The apparatus may further comprise at least one knuckle joint coupled between the first and second tools.

In an exemplary embodiment, the apparatus further comprises at least one centralizer coupled between the first tool and the second tool. For example, the apparatus may comprise a first centralizer, a second centralizer, a third centralizer, and a fourth centralizer, wherein the first tool is coupled between the first and second centralizers, the second tool is coupled between the third and fourth centralizers, and the second and third centralizers are coupled between the first and second tools. The apparatus may further comprise at least one knuckle joint coupled between the second and third centralizers.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A method for developing a wellbore deviation survey, comprising:

collecting wellbore deformation data using a caliper at each of a plurality of depths within a wellbore;

collecting wellbore deviation data at one or more of the plurality of depths;

collecting tool orientation data using an orientation tool at one or more of the plurality of depths;

orienting the wellbore deformation data and the wellbore deviation data with the tool orientation data;

determining simulated wellbore deformation data at each of a plurality of simulation depths using the oriented wellbore deformation data, including simulating a position of a model tool at the plurality of simulation depths along the length of a model wellbore, wherein each of the plurality of simulation depths corresponds to one of the plurality of depths within the wellbore;

determining simulated wellbore deviation data at one or more of the plurality of simulation depths using the simulated wellbore deformation data; and developing the wellbore deviation survey by calibrating the simulated wellbore deviation data, including adjusting the simulated wellbore deviation data at one or more of the plurality of simulation depths where the simulated wellbore deformation or deviation data does not agree with the oriented wellbore deformation or deviation data.

2. The method of claim 1, wherein developing the wellbore deviation survey by calibrating the simulated wellbore deviation data is based on the oriented wellbore deviation data.

3. The method of claim 1, wherein wellbore deviation data is collected without stopping at ones of the plurality of depths.

4. A system for developing a wellbore deviation survey, comprising:

means for collecting wellbore deformation data at each of a plurality of depths within a wellbore;

means for collecting wellbore deviation data at ones of the plurality of depths;

means for collecting tool orientation data at one or more of the plurality of depths;

means for orienting the wellbore deformation data and the wellbore deviation data with the tool orientation data;

means for determining simulated wellbore deformation data at each of a plurality of simulation depths using the oriented wellbore deformation data, including means for simulating a position of a model tool at the plurality of simulation depths along the length of a model wellbore, wherein each of the plurality of simulation depths corresponds to one of the plurality of depths within the wellbore;

means for determining simulated deviation data at one or more of the plurality of simulation depths using the simulated wellbore deformation data; and means for developing a wellbore deviation survey by calibrating the simulated wellbore deviation data, including means for adjusting the simulated wellbore deviation data at one or more of the plurality of simulation depths where the simulated wellbore deformation or deviation data does not agree with the oriented wellbore deformation or deviation data.

5. The system of claim 4, wherein the means for developing the wellbore deviation survey by calibrating the simulated wellbore deviation data is based on the oriented wellbore deviation data.

6. The method of claim 4, wherein the means for collecting the wellbore deviation data does not stop at one or more of the plurality of depths.

7. A system for developing a wellbore deviation survey, comprising:

a module configured to collect oriented wellbore deformation data at each of a plurality of depths within a wellbore;

a module configured to collect oriented wellbore deviation data at one or more of the plurality of depths;

a module configured to collect tool orientation data at one or more of the plurality of depths;

a module configured to orient the wellbore deformation data and the wellbore deviation data with the tool orientation data;

a module configured to determine simulated wellbore deformation data at each of a plurality of simulation depths using the oriented wellbore deformation data, including a module component configured to simulate a position of a model tool at the plurality of simulation depths along the length of a model wellbore, wherein each of the plurality of simulation depths corresponds to one of the plurality of depths within the wellbore;

a module configured to determine simulated deviation data at one or more of the plurality of simulation depths using the simulated wellbore deformation data; and a module configured to develop a wellbore deviation survey by calibrating the simulated wellbore deviation data, including a module component configured to adjust the simulated wellbore deviation data at one or more of the plurality of simulation depths where the simulated wellbore deformation or deviation data does not agree with the oriented wellbore deformation or deviation data.

8. The system of claim 7, wherein the module for developing the wellbore deviation survey by calibrating the simulated wellbore deviation data is based on the oriented wellbore deviation data.

9. The system of claim 7, wherein the module configured to collect the oriented wellbore deviation data does not stop at one or more of the plurality of depths during the data collection.

10. A computer program product embodied on a non-transitory computer-usable medium, the medium having stored thereon a sequence of instructions which, when executed by a processor, causes the processor to execute a method for wellbore tracking, the method comprising:

collecting wellbore deformation data at each of a plurality of depths within a wellbore;

collecting wellbore deviation data at one or more of the plurality of depths;

collecting tool orientation data at one or more of the plurality of depths;

orienting the wellbore deformation data and the wellbore deviation data with the tool orientation data;

determining simulated wellbore deformation data at each of a plurality of simulation depths using the oriented wellbore deformation data, including simulating a position of a model tool at the plurality of simulation depths along the length of a model wellbore, wherein each of the plurality of simulation depths corresponds to one of the plurality of depths within the wellbore;

determining simulated wellbore deviation data at one or more of the plurality of simulation depths using the simulated wellbore deformation data; and developing the wellbore deviation survey by calibrating the simulated wellbore deviation data, including adjusting the simulated wellbore deviation data at one or more of the plurality of simulation depths where the simulated wellbore deformation or deviation data does not agree with the oriented wellbore deformation or deviation data.

11. The computer program product of claim 10, wherein developing the wellbore deviation survey by calibrating the simulated wellbore deviation data on the oriented wellbore deviation data.

12. The computer program product of claim 10, wherein wellbore deviation data is collected without stopping at one or more of the plurality of depths.

13. A system comprising:

a first tool configured to collect wellbore deformation data in-situ at each of a plurality of depths within a wellbore;

a second tool different from and coupled to the first tool, the second tool configured to collect wellbore deviation data in-situ at one or more of the plurality of depths;

a third tool coupled to either the first or second tool and configured to collect orientation data in-situ at one or more of the plurality of depths, wherein the collected wellbore deformation and deviation data is configured to be oriented with the tool orientation data;

a module configured to determine simulated wellbore deformation data at each of a plurality of simulation depths using oriented wellbore deformation data, including a module component configured to simulate a position of a model tool at the plurality of simulation depths along the length of a model wellbore, wherein each of the plurality of simulation depths corresponds to one of the plurality of depths within the wellbore;

a module configured to determine simulated deviation data at one or more of the plurality of simulation depths using the simulated wellbore deformation data; and a module configured to develop a wellbore deviation survey by calibrating the simulated wellbore deviation data, including a module component configured to adjust the simulated wellbore deviation data at one or more of the plurality of simulation depths where the simulated wellbore deformation or deviation data does not agree with oriented wellbore deformation or deviation data.

14. The system of claim 13, wherein the first tool comprises a caliper tool including multiple arm-like or finger-like members.

15. The system of claim 13, wherein the second tool comprises a tiltmeter.

16. The system of claim 13, further comprising at least one centralizer coupled between the first tool and the second tool.

17. The system of claim 13, further comprising a first centralizer, a second centralizer, a third centralizer, and a fourth centralizer, wherein the first tool is coupled between the first and second centralizers, the second tool is coupled between the third and fourth centralizers, and the second and third centralizers are coupled between the first and second tools.

18. The system of claim 17, further comprising at least one knuckle joint coupled between the second and third centralizers.

19. The system of claim 13, further comprising at least one knuckle joint coupled between the first and second tools.

20. The system of claim 13, further comprising a first centralizer, a second centralizer, a third centralizer, a fourth centralizer, and at least one knuckle joint, wherein the first tool is coupled between the first and second centralizers, the second tool is coupled between the third and fourth centralizers, the second and third centralizers are coupled between the first and second tools, the at least one knuckle joint is coupled between the second and third centralizers, the first tool comprises a caliper tool, and the second tool comprises a tiltmeter.

21. The system of claim 13, wherein the third tool is at least one of the following: a conventional or north seeking mechanical gyroscope, a fiber optic gyroscope, a radio frequency orientation detector, a heat sensor orientation detector, or a sound wave orientation detector.

22. The system of claim 13, wherein the third tool calculates the orientation of the apparatus using a wellbore deviation measurement and a known azimuth.

23. The system of claim 13, wherein the first tool, the second tool, and the third tool are contained within a common housing.

* * * * *